US005888089A

United States Patent [19]

Konoya et al.

[11] Patent Number: 5,888,089

[45] **Date of Patent: *Mar. 30, 1999**

[54] ELECTRICAL CONNECTION BOX

[75] Inventors: Hisashi Konoya; Nori Inoue, both of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 663,678

[22] Filed: Jun. 14, 1996

[30] Foreign Application Priority Data

Jun. 30, 1995 [JP] Japan ..... 7-165789

[51] Int. Cl.[6] ..... H01R 4/24

[52] U.S. Cl. ..... 439/404; 439/76.2; 439/949

[58] Field of Search ..... 439/76.2, 404, 439/405, 395, 396, 949

[56] References Cited

U.S. PATENT DOCUMENTS

| | | | |
|---|---|---|---|
| 2,613,309 | 10/1952 | Frere | 439/404 |
| 4,674,819 | 6/1987 | Fujitani et al. | 439/498 |
| 4,684,765 | 8/1987 | Beck et al. | 174/68.5 |
| 4,758,536 | 7/1988 | Miller et al. | 439/405 |
| 4,938,719 | 7/1990 | Sawai et al. | 439/404 |
| 5,289,633 | 3/1994 | Okafuji et al. | 29/850 |
| 5,310,353 | 5/1994 | Parrish et al. | 439/76.2 |
| 5,618,186 | 4/1997 | Saka et al. | 439/76.2 |
| 5,782,651 | 7/1998 | Koneya | 439/405 |

FOREIGN PATENT DOCUMENTS

| | | |
|---|---|---|
| 0044636 | 1/1982 | European Pat. Off. . |
| 0470887 | 2/1992 | European Pat. Off. . |
| 2331169 | 6/1977 | France . |

OTHER PUBLICATIONS

EPO—Patent Abstracts of Japan, Publication #04051480, Publication date: 19 Jan. 1992 (one page Abstract only).

*Primary Examiner*—Gary Paumen
*Assistant Examiner*—Tho Dac Ta
*Attorney, Agent, or Firm*—Jordan B. Bierman; Bierman, Muserlian and Lucas

[57] ABSTRACT

Opposed inner surfaces of lower and upper casings making up a connection box are flat, and wire arrangement grooves are formed in the inner surfaces. Insertion holes communicate with the wire arrangement grooves in specified positions and are open to the outer surfaces of the casings. A wire is laid into the wire arrangement grooves and is pressed into the slots of the cramping terminals mounted in the insertion holes. The tabs on the cramping terminals project from the outer surfaces of the casings. The casings are held together by nuts and bolts or other devices after the flat inner surfaces are in contact with each other.

16 Claims, 8 Drawing Sheets

ELECTRICAL CONNECTION BOX

This Application claims the priority of Japanese Application 7-165789, filed Jun. 30, 1995.

The present Invention relates to an electrical connection box and is particularly designed to form internal circuits including wires, cramping terminals, fuses, relays, and the like to produce a plurality of electrical circuits in a compact manner to form branch connections of wiring harnesses. Especially, the present Invention is directed to an arrangement of wires in the casing of the connection box which will increase the space available for electrical circuitry.

BACKGROUND OF THE INVENTION

In an electrical connection box, internal circuits are generally constructed of busbars punched from a conductive metal plate. An electrical connection box is known in which internal circuits are composed of wires and cramping terminals in order to provide flexibility for accommodating design changes in the internal circuits.

In connection boxes of this type, as shown in FIGS. 9 to 11, cramping terminals 2 are mounted in casing 1 which can be the lower casing and/or the upper casing thereof. Wires 3 are arranged in casing 1 while being pressed into cramping terminals 2 to form an electrical connection therewith (see Japanese Unexamined Utility Model Publication No. 6-24324). Wires 3 are normally arranged according to a desired pattern using wire laying head 5 of a wire laying apparatus (see FIG. 10).

However, if wire 3 being fed from head 5 is to be located on the inner surface of upper or lower casing 1, it cannot be laid in the hatched area of FIG. 11 due to interference of head 5 with side wall 1*a* projecting from the outer periphery of casing 1. In other words, head 5 cannot place wire 3 closer to side wall 1*a* than distance L; thus, the space for wire arrangement is reduced. Therefore, in order to form desired circuits, the entire connection box must be enlarged.

To solve this problem, in the prior art, a mold for arranging wires 3 is provided separately, and the wires are arranged in the desired pattern using the usual wire laying apparatus. Thereafter, casing 1, with cramping terminals therein, is placed adjacent the mold, and the arranged wires are pressed into casing 1 to thereby make the desired electrical connections with cramping terminals 2.

However, in this case, there are problems such as poor working efficiency because of the wire transferring step and increased production cost because of the need to prepare a multitude of wire arrangement molds in conformity with different arrangement patterns.

SUMMARY OF THE INVENTION

In view of the above problems, it is an object of the present Invention to provide an electrical connection box in which internal circuits are constructed by wires and cramping terminals, and wires can be directly laid on the casing without reducing the space available for the wire pattern.

According to the Invention, there is provided an electrical connection box comprising two complementary casings, having outer surfaces, the opposite inner surfaces thereof having at least two separate supporting abutting areas. Wire arrangement grooves are formed in the inner surfaces, and insertion holes which communicate with the wire arrangement grooves and are open to the outer surfaces of the casings, are located at predetermined positions. There are terminals insertable through the insertion holes, and wires in the wire arrangement grooves and connected to the terminals.

According to a preferred embodiment, each terminal comprises a tab, so that the terminals are insertable through the insertion holes and the tabs project on or from the outer surfaces of the casings. Each terminal comprises a wire connection for receiving a wire and, when pressure is exerted, cutting through the insulation thereon to make contact with the conductive core. Advantageously, the terminals are cramping terminals.

In an construction of particular usefulness, the electrical connection box comprises lower and upper casings having opposed inner surfaces which are substantially flat, especially including their outer peripheries. Wire arrangement grooves are formed in the flat inner surfaces and insertion holes communicate with the wire grooves in specified positions and are open to the outer surfaces of both casings. Cramping terminals, each having a tab, are inserted through the insertion holes so that their tabs project through and beyond the outer surfaces of the casings, and the wires are in the wire arrangement grooves and pressed into the wire connection portions of the cramping terminals to make electrical contact therewith.

The cramping terminals are pressed into the through holes formed in the casings so that their tabs project from the outer surfaces thereof. Subsequently, the wires are laid in the wire arrangement grooves using the wire laying apparatus. Since the inner surfaces of the casings where the wire arrangement grooves are formed are flat, and no frame-shaped side walls project from the casings (as in the prior art), the wire laying head encounters no interference. This effectively eliminates the reduction in available space indicated by the hatched area in FIG. 9. Thus, the wire pattern can be located over the entire inner surfaces of the casings.

The lower and upper casings are connected, for example, by the use of nuts and bolts or by fusing the projecting ends of fusible screws inserted through both casings after the opposite inner surfaces are placed in contact with each other. Thus, the casings can be securely held together. Alternatively, the casings may be connected by securing members which are inserted into through holes in the casings after placing the flat inner surfaces thereof in contact with each other. Thus, the casings can be easily connected and assembled during manufacture and, for maintenance, they can be easily disassembled. The casings may also be secured to each other by a frame which encompasses a portion of the outer surfaces or sides of the lower and upper casings.

These and other objects, features, and advantages of the present Invention are more specifically shown in the accompanying drawings, constituting a part hereof and in which like reference characters indicate like parts, FIG. 1 is an exploded perspective view of a connection box according to the Invention;

FIGS. 2(A) and 2(B) are sections along A—A and B—B, respectively, of FIG. 1 showing the assembled connection box;

FIG. 3 is an enlarged fragmentary section showing one construction for holding the casings together;

FIGS. 4(A) and 2(B) are an exploded perspective view and a section of the connection box showing another construction for securing the casings together;

FIGS. 5(A) and 2(B) are views similar to FIGS. 4(A) and 4(B), showing a further construction for holding the casings together;

FIG. 6 is an exploded perspective view of the frame securing the casings together;

FIGS. 7(A) and 7(B) are similar to FIGS. 5(A) and 5(B) showing another construction securing the casings together;

FIGS. 8(A) and 8(B) are a similar to FIGS. 7(A) and 7(B) showing another construction for holding the casings together;

Figure 1:
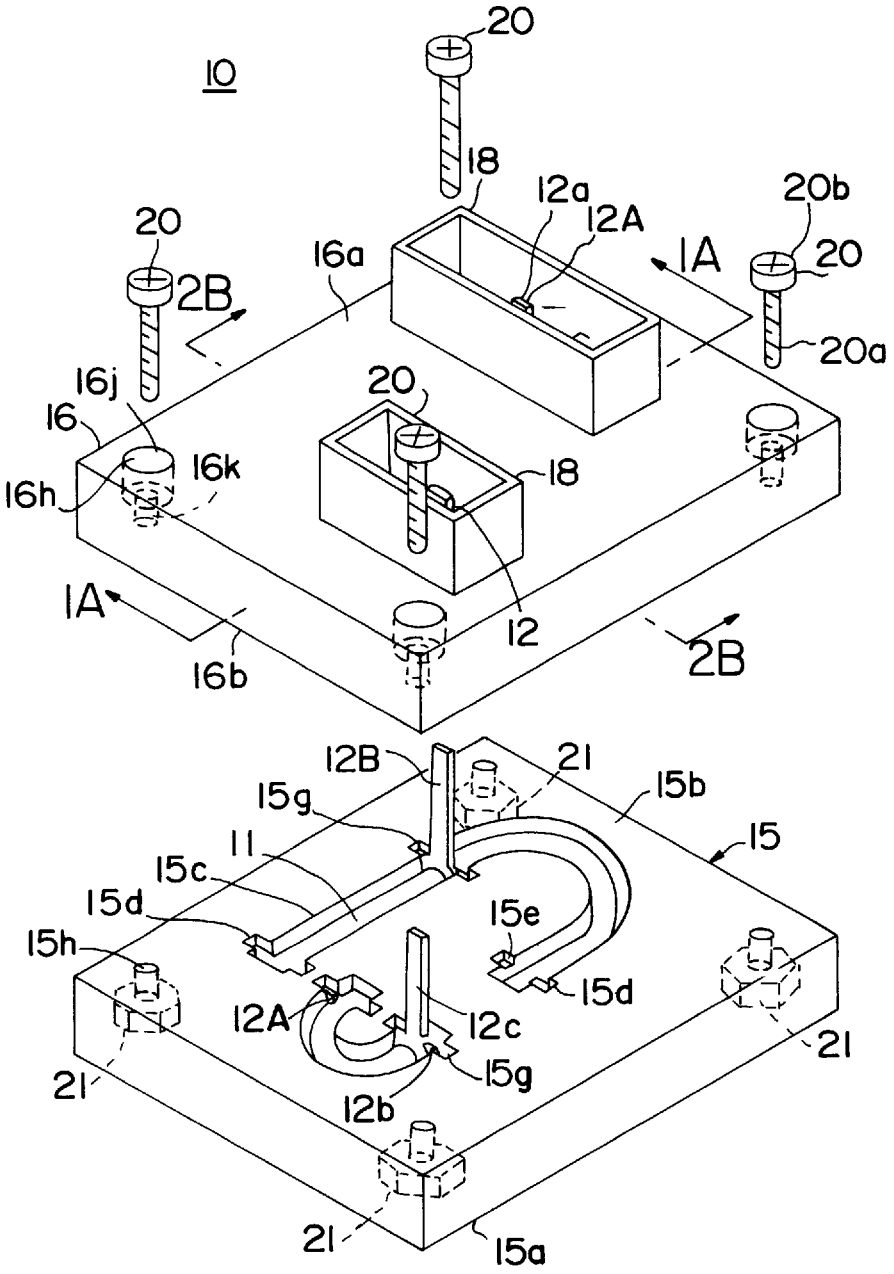
Figure 2A:
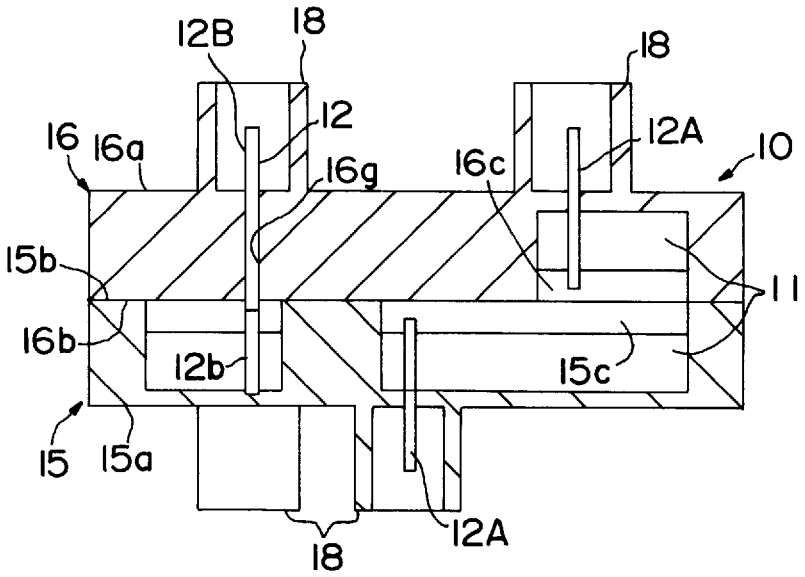
Figure 2B:
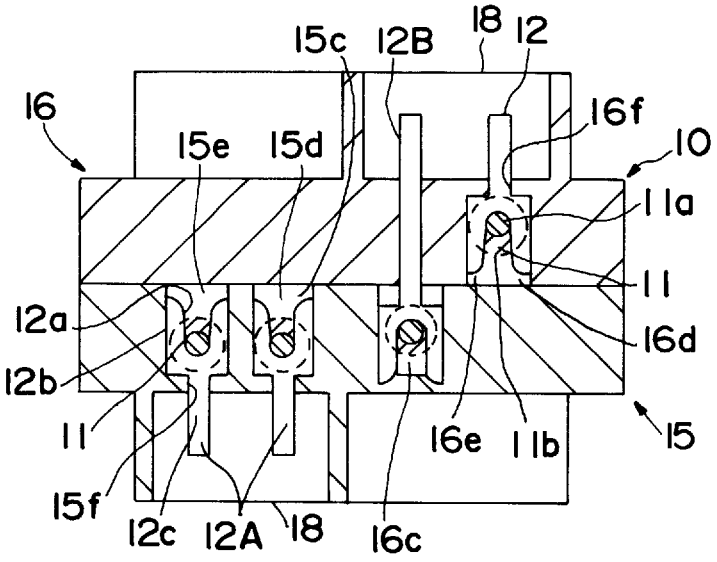

Referring to FIGS. 1, 2(A) and 2(B), connection box 10 contains internal circuits comprised of wires 11 and cramping terminals 12. Wires 11 are laid in lower and upper casings 15 and 16 without using wire arrangement molds, and are pressed into cramping terminals 12 securely mounted in the casings 15 and 16 to make electrical contact therewith. Cores 11*a* of wires 11 are covered by insulation sheath 11*b*. Cramping terminals 12 have a known shape; wire connection portion 12*b* has slot 12*a* at one end and tab 12*c* is a contact to be connected to an external circuit at its remote end. Insulation sheath 11*b* is penetrated by a cutting edge of slot 12*a*, thereby bringing wire connection portion 12*b* into contact with core 11*a*.

There are two types of cramping terminals 12, cramping terminals 12A, which are mounted in casings 15 and 16 before the insertion of wires 11, and cramping terminals 12B, which are mounted after the insertion of wires 11. Cramping terminals 12A are mounted in lower casing 15 or upper casing 16 so that tab 12*c* projects beyond outer surface 15*a* or outer surface 16*a*. Cramping terminal 12B is mounted in lower casing 15 so that its tab 12*c* projects from outer surface 16*a* of upper casing 16. Tab 12*c* of cramping terminal 12B is longer than that of cramping terminal 12A.

Opposite inner surfaces 15*b* and 16*b* of casing 15 and 16 are substantially flat, especially the outer peripheries thereof. Wire arrangement grooves 15*c* and 16*c* are in inner surfaces 15*b* and 16*b* to receive wires 11 in accordance with the wiring pattern of the internal circuits. On outer surfaces 15*a* and 16*a*, are connector receptacles 18 into which connectors (not shown) connected to external circuits are fittable. Receptacles for relays, fuses and the like may be formed if necessary.

Casings 15 and 16 are provided with insertion holes 15*d* and 16*d* for cramping terminals 12A which communicate with wire arrangement grooves 15*c* and 16*c* in specified positions and are open to outer surfaces 15*a* and 16*a*. Insertion holes 15*d* and 16*d* include mount portions 15*e* and 16*e*, which are wider than wire arrangement grooves 15*c* and 16*c*, and into which wire connection portions 12*b* of cramping terminals 12A are fitted. Tab mount portions 15*f* and 16*f* are continuous with—but narrower than—mount portions 15*e* and 16*e*, respectively. Tab mount portions 15*f* and 16*f* are open to the floors of connector receptacles 18 on outer surfaces 15*a* and 16*a* of casings 15 and 16. Lower casing 15 is provided with mount portions 15*g* for cramping terminals 12B in specified positions of wire grooves 15*c*. Upper casing 16 is formed with tab mount portions 16*g* for cramping terminals 12B in positions opposite mount portions 15*g*. Tab mount portions 15*g* are open to the floors of connector receptacles 18 on outer surface 16*a*.

Lower casing 15 has, at its four corners, bolt insertion holes 15*h* into which shafts 20*a* of bolts 20 are inserted and nuts 21 are mounted inside bolt insertion holes 15*h*. Upper casing 16 has funnel-shaped bolt insertion holes 16*h* each including a head mount portion 16*j*, adapted to receive and retain head 20*b*, located on the outer side of casing 16 and shaft mount portion 16*k* located on the inner side of casing 16.

To assemble the connection of the present Invention, cramping terminals 12A are placed in insertion holes 15*d* and 16*d* so that wire connection portions 12*b* of cramping terminals 12A are in mount portions 15*e* and 16*e* and tabs 12*c* project into connector receptacles 18. Subsequently, as with a prior art connection box, wires 11 are laid directly into wire grooves 15*c* and 16*c* by wire laying head 5.

Unlike casing 1 of the prior art, in which the frame-shaped side wall 1*a* projects at the outer periphery, inner surfaces 15*b* and 16*b* are substantially flat, especially at their outer peripheries. Accordingly, wire laying head 5 is not impeded by side wall 1*a* or the like. Therefore, even if wires 11 are laid directly in the casings 15 and 16 using the wire laying apparatus, wires 11 can be arranged over the entire inner surfaces 15*b* and 16*b*; no space for arranging the wires 11 is rendered unusable.

After the wires 11 are arranged in respective casings 15 and 16, cramping terminals 12B are pressed into mount portions 15*g* of lower casing 15, thereby connecting cramping terminals 12B with wires 11 and causing long tabs 12*c* to project from inner surface 15*b*. Thereafter, upper casing 16 is placed over lower casing 15 so that flat inner surfaces 15*b* and 16*b* are in contact with each other, while tabs 12*c* of cramping terminals 12B are inserted into tab mount portions 16*g* of upper casing 16.

Figure 3:
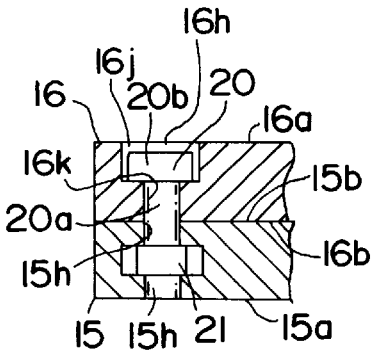

Lastly, after inner surfaces 15*b* and 16*b* are coupled, bolts 20 are inserted through bolt insertion holes 16*h* from the upper surface of the upper casing 16 until shafts 20*a* thereof enter bolt insertion holes 15*h* in lower casing 15. Then, as shown in FIG. 3, shafts 20*a* are fastened with nuts 21 inside bolt insertion holes 15*h*, thereby connecting the lower and upper casings. In this way, the casings are securely connected by bolts 20 and nuts 21.

Figure 4A:
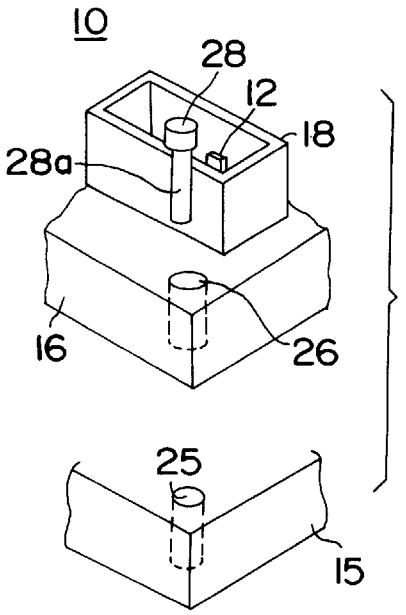
Figure 4B:
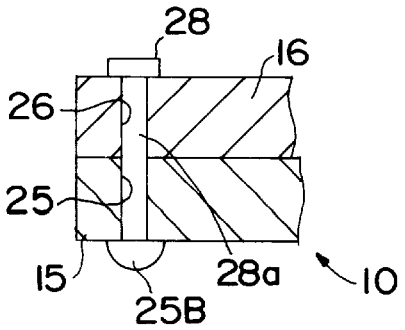

FIGS. 4(A) and 4(B) show connection box 10 according to a modification of the Invention. Lower and upper casings 15 and 16 have, in each of their four corners, through holes 25 and 26. Shafts 28*a* of screws 28 are inserted into through holes 26 and 25 from upper casing 16 and the leading ends of shafts 28*a*, projecting from lower casing 15 are fused to form enlarged portions 25B as shown in FIG. 4(B).

Figure 5A:
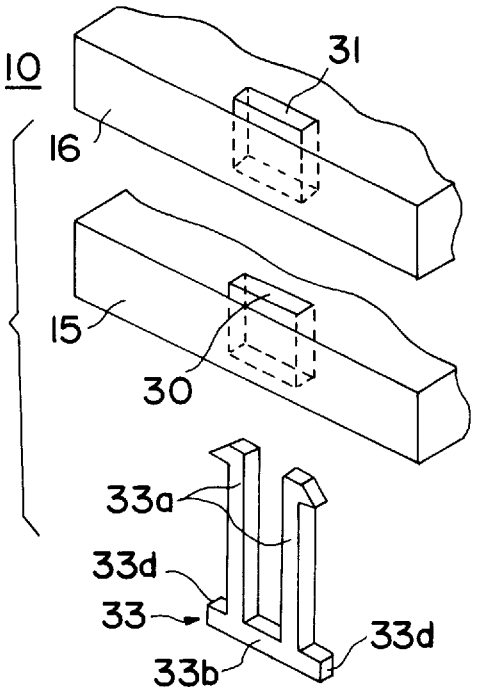
Figure 5B:
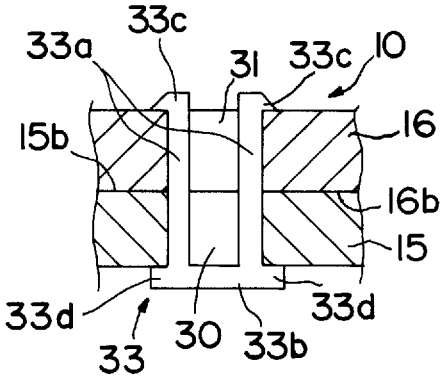

FIGS. 5(A) and 5(B) show a further modification of the Invention. In connection box 10, substantially rectangular through holes 30 and 31 are provided in the opposite longitudinal ends of casings 15 and 16, and connection member 33 is inserted therethrough. Connection member 30 includes a pair of resilient portions 33*a* to be located at the opposite longitudinal ends of each of through holes 30 and 31, connection portion 33*b* extending between one end of each of resilient portions 33*a*, and locking claws 33*c* projecting outward at the outer ends of the resilient portions. Connection portion 33*b* includes projected portions 33*d* extending further outward from resilient members 33*a*.

To insert connection member 33, resilient members 33*a* are pressed into through holes 30 and 31 from outside of lower casing 15, while deformed toward each other. When locking claws 33*c* have passed through through holes 30 and 31, they engage outer surface 16*a* of upper casing 16, and projected portions 32*d* engage outer surface 15*a* of lower casing 15.

Figure 6:
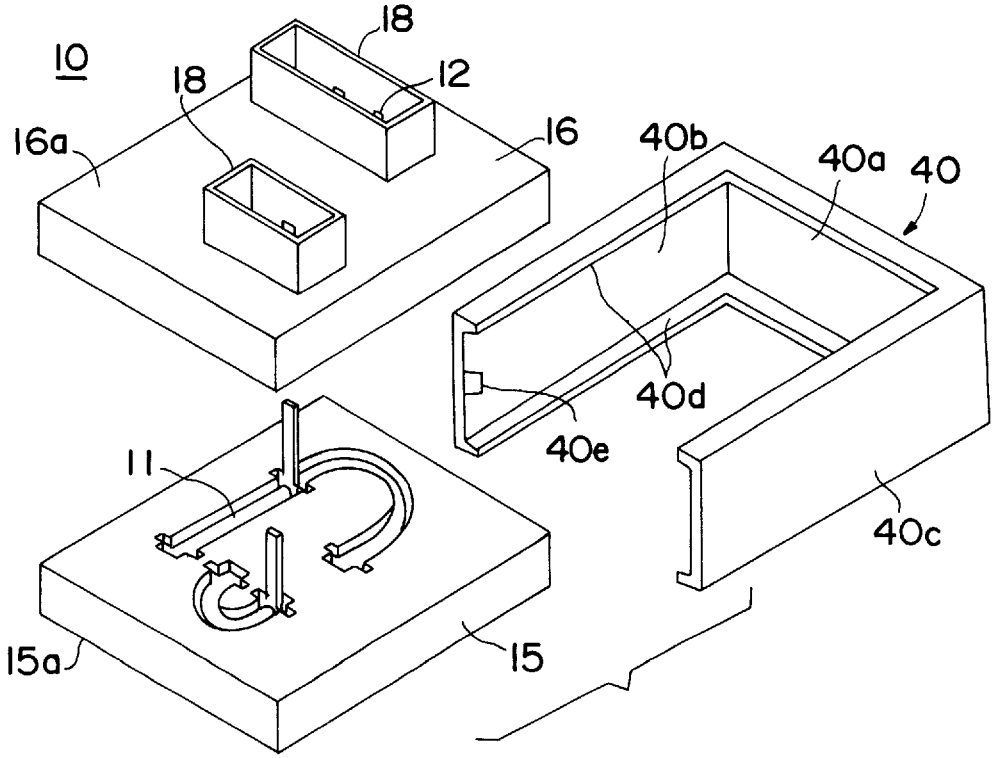

FIG. 6 shows an additional modification of the Invention. Instead of holes for connection, lower and upper casings 15 and 16 are retained in U-shaped connection member 40 with upper casing 16 placed over lower casing 15. Connection member 40 includes side walls 40*a*, 40*b*, and 40*c* which are shaped to cover three side surfaces of box 10, and ribs 40*d* projecting inward from upper and lower edges of the respective side walls. The ribs engage outer surfaces 15*a* and 16*a* of casings 15 and 16. Further locking claws 40*e* are located approximately midway between the upper and lower edges of the leading ends of the inner surfaces of side walls 40*b* and 40*c*. Locking claws 40*e* engage the side surfaces of casings 15 and 16 which are not covered by side walls 40*a*, 40*b*, and 40*c*. This holds casings 15 and 16 within connection member 40.

Figure 7A:
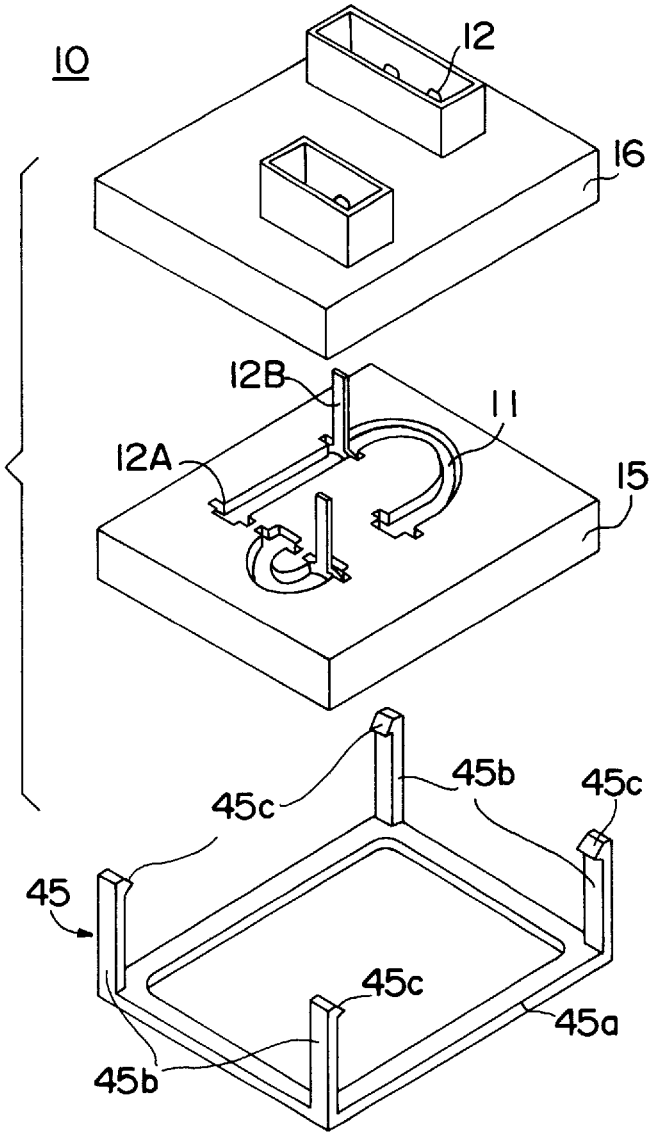
Figure 7B:
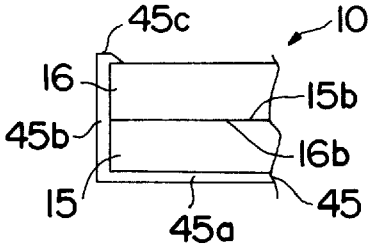

A modification of the foregoing is shown in FIGS. 7(A) and 7(B). Casings 15 and 16 are held by a frame connection member 45 with upper casing 16 placed over lower casing 15. Connection member 45 includes substantially rectangular frame 45*a* having an outer shape complementary to and slightly larger than the outer shape of the casings. Resilient portions 45*b* project upward from the four corners of frame 45*a*, and locking claws 45*c* are at the leading ends of resilient portions 45*b* to engage the outer surface of casing 15 or 16.

Figure 8A:
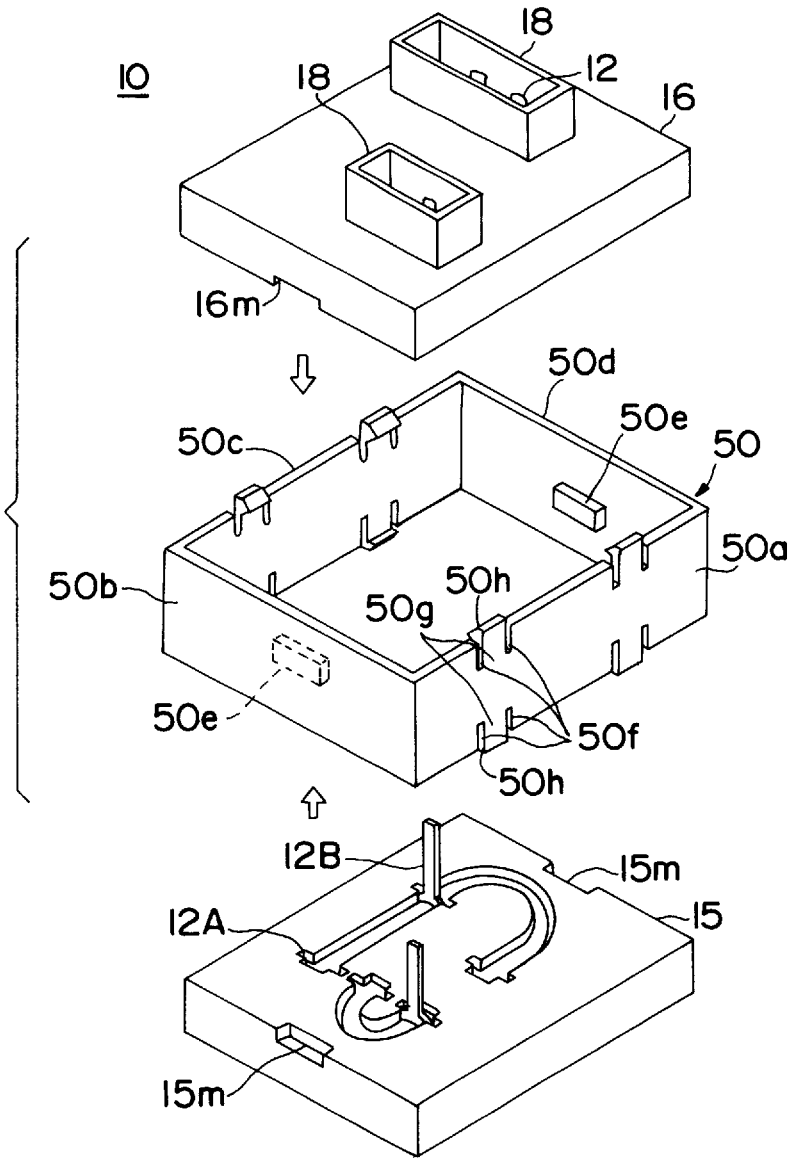
Figure 8B:
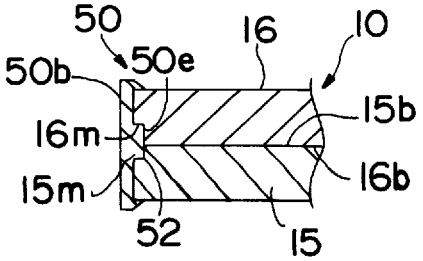
Figure 9:
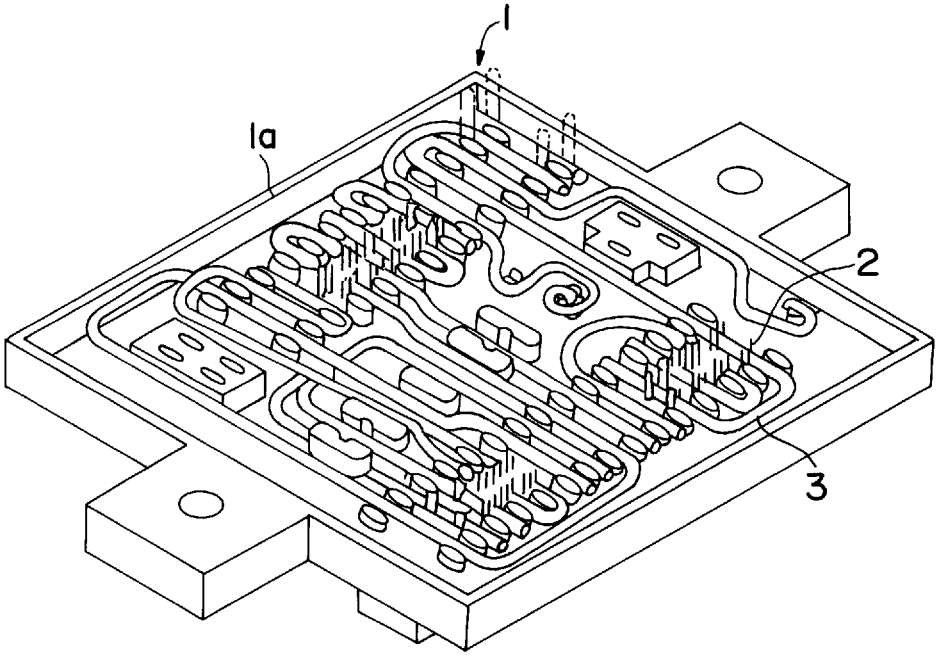
FIG. 9 PRIOR ART
FIG. 9 is a perspective view of a casing of a prior art connection box.
Figure 10:
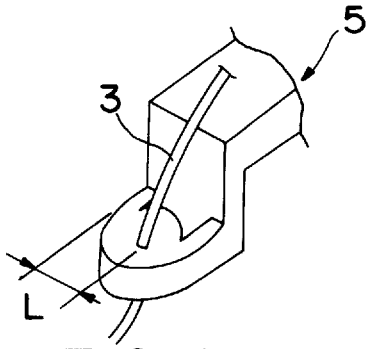
FIG.10 PRIOR ART
FIG. 10 is a perspective view of a wire laying head of the prior art.
Figure 11:
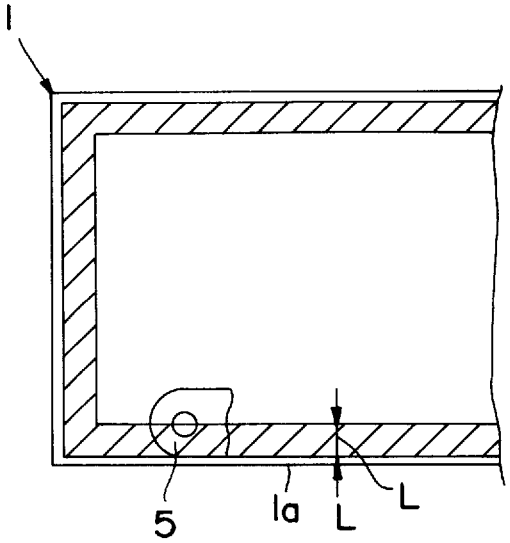
FIG. 11 PRIOR ART
FIG. 11 is a schematic diagram showing a problem which arises in the prior art when the wires are laid in the casing of FIG. 9 by the wire laying head.

Another form of the Invention is to be found in FIGS. 8(A) and 8(B). Casings 15 and 16 are held by frame connection member 50 with upper casing 16 placed over lower casing 15. When connection box 10 is assembled, casings 15 and 16 are inserted from opposite openings in connection member 50. The casings have positioning recesses 15*m* and 16*m* in about the middle of opposite longitudinal ends of their inner surfaces. Recess 15*m* and 16*m* unite to form a single substantially rectangular combined recess 52 to ensure that upper casing 16 is properly placed over lower casing 15. Connection member 50 is a rectangular frame which fits over the outer surfaces of casings 15 and 16. Positioning projections 50*e* are on the inner surface of shorter side walls 50*b* and 50*d* and conform to combined recesses 52.

Further, pairs of slits 50*f* are found in specified positions of the upper and lower edges of longer side walls 50*a* and 50*c*. Resilient tongues 50*g* are between pairs of slits 50*f*, and locking claws 50*h* which engage outer surfaces 15*a* and 16*a* are formed at the leading ends of resilient portions 50*g*.

Connection box 10 according to this form of the Invention is assembled by mounting cramping terminals 12A in the lower and upper casings, and laying down wires 11 by means of a wire laying apparatus. Then, cramping terminals 12B are mounted in lower casings 15. Thereafter, lower casing 15 is inserted into connection member 50 through the lower opening so that positioning recesses 15*m* engage the lower halves of positioning projections 50*e* and locking claws 50*h* engage outer surfaces 15*a*. Similarly, upper casing 16 is then inserted into connection member 50 through the upper opening so that casings 15 and 16 are held together with their flat inner surfaces 15*b* and 16*b* in contact with each other.

While only a limited number of specific embodiments have been expressly disclosed, the Invention is, nonetheless to be broadly construed and not to be limited except by the character of the claims appended hereto.

What we claim is:

1. An electrical connection box comprising an upper casing and a complementary lower casing, said upper casing being bounded by an upper periphery, said lower casing being bounded by a lower periphery, said upper casing having a first inner surface, said lower casing having a second inner surface, said first inner surface facing said second inner surface, said first inner surface and said upper periphery being substantially in one upper plane, said second inner surface and said lower periphery being substantially in one lower plane, said first surface and said second surface being in contact with each other; wherein said first inner surface and second inner surface are substantially planar;

said upper casing having a first outer surface facing away from said lower casing, said lower casing having a second outer surface facing away from said upper casing;

upper wire grooves formed in said first inner, surface and lower wire grooves formed in said second inner surface, said upper grooves and said lower grooves forming a predetermined pattern;

a first set of upper insertion holes in said upper casing in communication with said upper wire grooves corresponding thereto and open to said first outer surface, lower insertion holes in said lower casing in communication with said lower wire grooves corresponding thereto and open to said second outer surface;

a second set of upper insertion holes in said upper casino in communication with said lower wire grooves corresponding thereto and open to said first outer surface;

upper terminals in said first set of upper insertion holes, a first set of lower terminals in said lower insertion holes, a second set of lower terminals in said second set of upper insertion holes, electrically conductive wires in said upper wire grooves and in electrical contact with said upper terminals, electrically conductive wires in said lower wire grooves in electrical contact with said first and second set of lower terminals.

2. The connection box of claim 1 wherein said upper casing is affixed to said lower casing.

3. The connection box of claim 1 wherein each of said upper terminals and each of said first and second set of lower terminals comprises a U-shaped wire connection portion adapted to receive one of said wires, penetrate insulation thereon, and make electrical contact therewith.

4. The connection box of claim 3 wherein each of said upper terminals and each of said first set of lower terminals comprises a first elongated tab extending through one of said first upper insertion holes and one of said lower insertion holes, each said first elongated tab further extending beyond said first outer surface or said second outer surface and each of said second set of lower terminals comprising a second elongated tab extending through one of said second upper insertion holes, said second elongated tab being longer in length than said first elongated tab.

5. The connection box of claim 1 wherein said upper casing includes an upper through hole extending from said first outer surface to said first inner surface, saint lower casing including a lower through hole extending from said second outer surface to said second inner surface, said lower through hole and said upper through hole in register with each other, a securing member in said upper hole and said lower hole, a first end of said securing member bearing against said first outer surface, a second end of said securing member, remote from said first end, bearing against said second outer surface, thereby retaining said first inner surface and said second inner surface in contact with each other.

6. The connection box of claim 5 wherein said first end or said second end comprises a base larger than said upper through hole or said lower through hole, another of said first end and said second end being larger than said upper through hole or said lower through hole and sufficiently resilient so that it can pass through said upper through hole and said lower through hole.

7. The connection box of claim 5 wherein said securing member comprises a U-shaped clip having a base, which is larger than said upper through hole or said lower through hole, and two spaced apart upstanding resilient arms, each having a locking claw on said second end, said resilient arms adapted to move toward each other on insertion into said lower through hole and said upper through hole, and to move away from each other after each said claw emerges from said upper through hole or said lower through hole.

8. The connection box of claim 1 wherein sail upper casing and said lower casing are held in juxtaposition to each other by a U-shaped frame having a rear wall and two side walls perpendicular thereto, said rear wall and said side walls being perpendicular to said first outer surface and said second outer surface, an upper edge on said rear wall and said side walls, a lower edge on said rear wall and said side walls, an upper rib on said upper edge, a lower rib on said lower edge, said upper rib and said lower rib projecting inwardly of said frame, said upper rib bearing against said first outer surface and said lower rib bearing against said second outer surface, whereby said first inner surface is maintained in contact with said second inner surface.

9. The connection box of claim 8 wherein said upper rib and said lower rib are throughout the edges of said rear wall and said side walls.

10. The connection box of claim 1 wherein said upper casing and said lower casing are held in juxtaposition to each other by a retaining frame comprising a rectangular periphery complementary to said lower casing or said upper casing and having four corners, an upstanding resilient member at at least two of said corners, a locking claw on an end of said resilient member remote from said corners, said locking claw adapted to bear against an outer edge of said first outer surface or said second outer surface, said periphery adapted to bear against an outer edge another of said first outer surface or said second outer surface, thereby maintaining said first inner surface in contact with said second inner surface.

11. The connection box of claim 10 wherein there is an upstanding member at each of said four corners.

12. The connection box of claim 1 wherein said upper casing and said lower casing are held in juxtaposition to each other by a retaining frame comprising a rectangular box-like-structure, complementary to said upper casing and said lower casing, having four walls perpendicular to said first, outer surface and said second outer surface, said walls having an upper edge and a lower edge, a plurality of resilient tongues on said upper edge and said lower edge projecting inwardly of said structure, and adapted to move outwardly of said structure.

13. The connection box of claim 12 wherein there are four resilient tongues on said upper edge and four resilient tongues on said lower edge.

14. The connection box of claim 12 wherein one of said walls carries a first positioning projection extending inwardly of said structure, a first positioning recess in said upper casing open to said first inner surface, a second positioning recess in said lower casing open to said second inner surface, said first recess and said second recess open to each other, thereby forming a first combined recess, said first positioning projection in said combined recess.

15. The connection box of claim 14 wherein there are two said positioning projections, two said combined recesses.

16. The connection box of claim 14 wherein there is a second said positioning projection on one of said walls opposite said first positioning projection, and a second combined recess, said second positioning projection in said second combined recess.

* * * * *

UNITED STATES PATENT AND TRADEMARK OFFICE

CERTIFICATE OF CORRECTION

PATENT NO. : 5,888,089

DATED : March 30, 1999

INVENTOR(S) : Hisashi Konoya, et al.

It is certified that error appears in the above-identified patent and that said Letters Patent is hereby corrected as shown below:

Column 2, line 54, delete "A-A and B-B" and insert --2A-2A and 2B-2B--.

Signed and Sealed this

Eighth Day of June, 1999

*Attest:*

Q. TODD DICKINSON

*Attesting Officer*

*Acting Commissioner of Patents and Trademarks*